US011383360B1

(12) United States Patent
Mancini

(10) Patent No.: US 11,383,360 B1
(45) Date of Patent: Jul. 12, 2022

(54) BOX WRENCH WITH POSITIONING-RETAINING TAB

(71) Applicant: Mario Mancini, Woodland Park, NJ (US)

(72) Inventor: Mario Mancini, Woodland Park, NJ (US)

( * ) Notice: Subject to any disclaimer, the term of this patent is extended or adjusted under 35 U.S.C. 154(b) by 348 days.

(21) Appl. No.: 16/787,191

(22) Filed: Feb. 11, 2020

(51) Int. Cl.
*B25B 23/10* (2006.01)
*B25B 13/04* (2006.01)

(52) U.S. Cl.
CPC ..... *B25B 23/10* (2013.01); *B25B 13/04* (2013.01)

(58) Field of Classification Search
CPC ..... B25B 23/10; B25B 23/0071; B25B 13/04; B25B 13/08
See application file for complete search history.

(56) References Cited

U.S. PATENT DOCUMENTS 2,659,258 A 11/1953 James
2,697,371 A * 12/1954 Bowman ..... B25B 13/08 81/125
4,570,513 A 2/1986 Thompson
4,787,273 A 11/1988 Griffith
5,832,795 A * 11/1998 Reynolds ..... B25B 13/46 81/13
6,701,808 B2 3/2004 Hsieh
6,889,581 B2 5/2005 Chen
8,245,605 B1 * 8/2012 Rygh ..... B25B 13/463 81/184
8,601,915 B1 * 12/2013 Garvey ..... B25B 23/0071 81/180.1
10,183,381 B2 * 1/2019 Li ..... B25B 23/0071
D842,667 S 3/2019 Macor
2005/0109169 A1 * 5/2005 Hsien ..... B25B 13/08 81/176.2
2015/0258670 A1 9/2015 Wang

FOREIGN PATENT DOCUMENTS

DE 887779 C * 6/1954 ..... B25B 13/04
DE 10204805 A1 * 8/2003 ..... B25B 13/08
WO 2010149999 12/2010

* cited by examiner

*Primary Examiner* — David B. Thomas
(74) *Attorney, Agent, or Firm* — Kyle A. Fletcher, Esq.

(57) ABSTRACT

The wrench with position-retaining tab comprises the box wrench and a position-retaining structure. The box wrench is a hand tool used for tightening and loosening a threaded connection formed by a bolt or bolt-like structure. The box wrench and the threaded connection are defined elsewhere in this disclosure. The position-retaining structure attaches to the box wrench. The position retaining structure is a spring-loaded structure that inhibits the box wrench from slipping off the bolt or bolt-like structure during the tightening and loosening of the threaded connection.

18 Claims, 2 Drawing Sheets

BOX WRENCH WITH POSITIONING-RETAINING TAB

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of performing operations including tools for fastening and disengaging objects, more specifically, an arrangement for holding and positioning a screw or nut prior to and during rotation. (B25B3/101)

SUMMARY OF INVENTION

The wrench with position-retaining tab comprises a box wrench and a position-retaining structure. The box wrench is a hand tool used for tightening and loosening a threaded connection formed by a bolt or bolt-like structure. The box wrench and the threaded connection are defined elsewhere in this disclosure. The position-retaining structure attaches to the box wrench. The position retaining structure is a spring loaded structure that inhibits the box wrench from slipping off the bolt or bolt-like structure during the tightening and loosening of the threaded connection.

These together with additional objects, features and advantages of the wrench with position-retaining tab will be readily apparent to those of ordinary skill in the art upon reading the following detailed description of the presently preferred, but nonetheless illustrative, embodiments when taken in conjunction with the accompanying drawings.

In this respect, before explaining the current embodiments of the wrench with position-retaining tab in detail, it is to be understood that the wrench with position-retaining tab is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wrench with position-retaining tab.

It is therefore important that the claims be regarded as including such equivalent construction insofar as they do not depart from the spirit and scope of the wrench with position-retaining tab. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
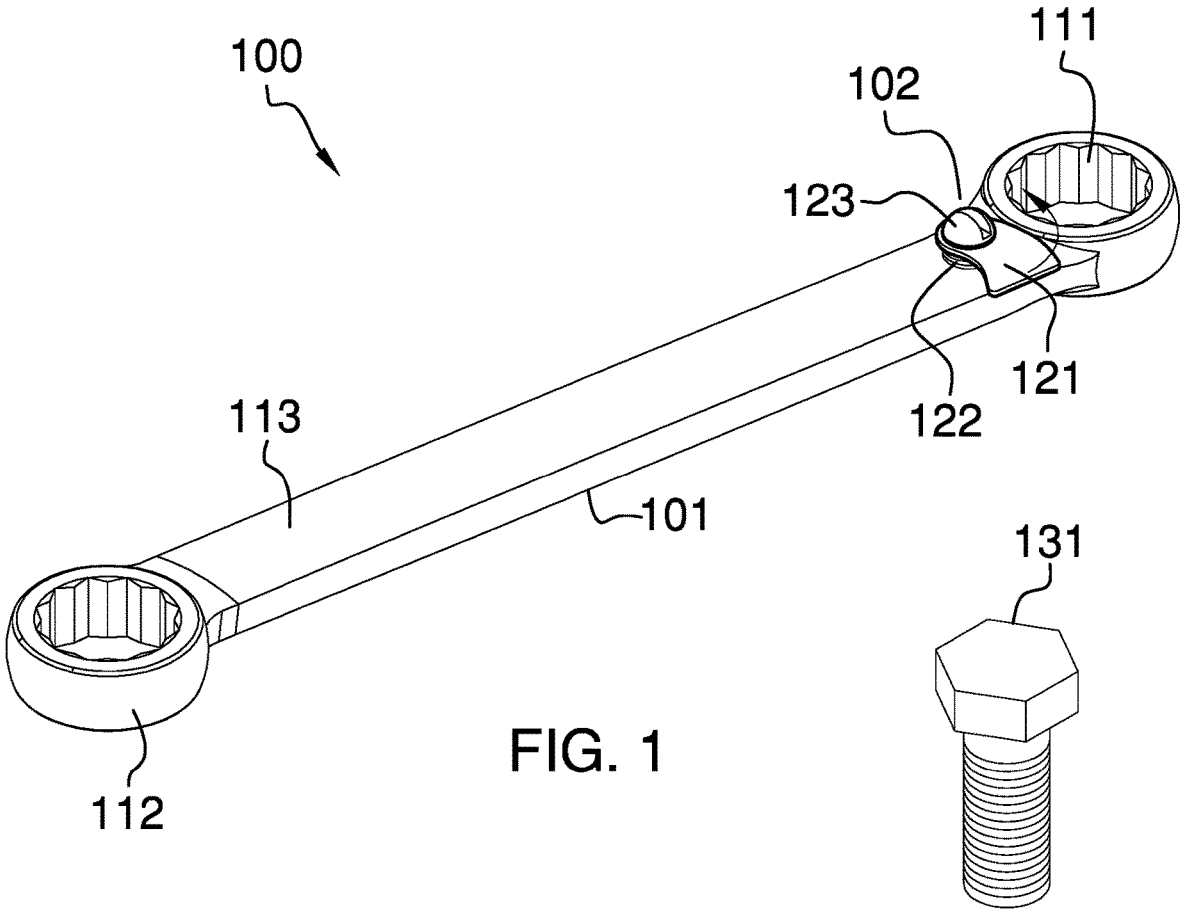
FIG. 1 is a perspective view of an embodiment of the disclosure.
Figure 2:
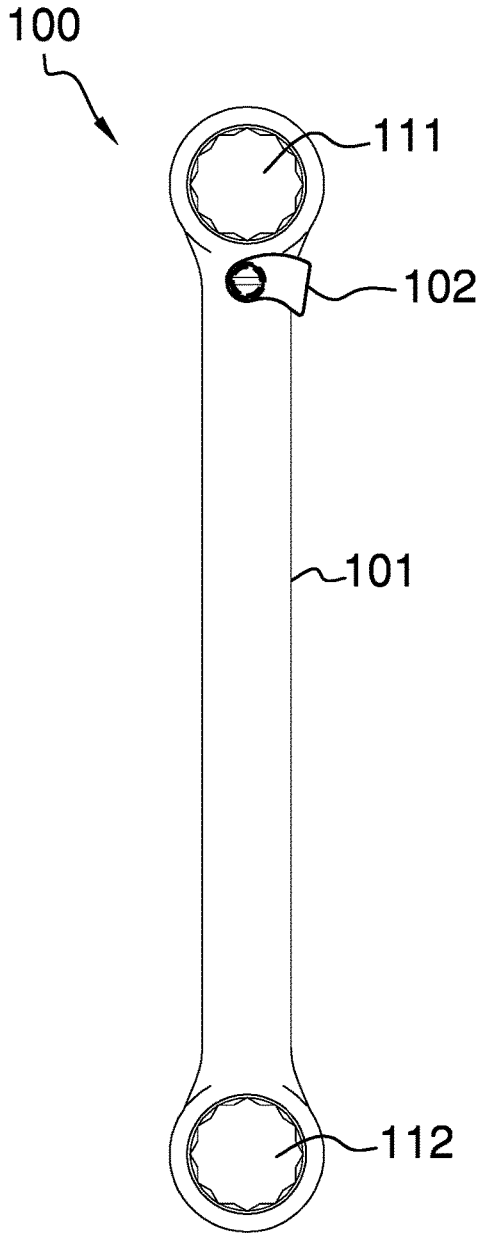
FIG. 2 is a top unlocked view of an embodiment of the disclosure.
Figure 3:
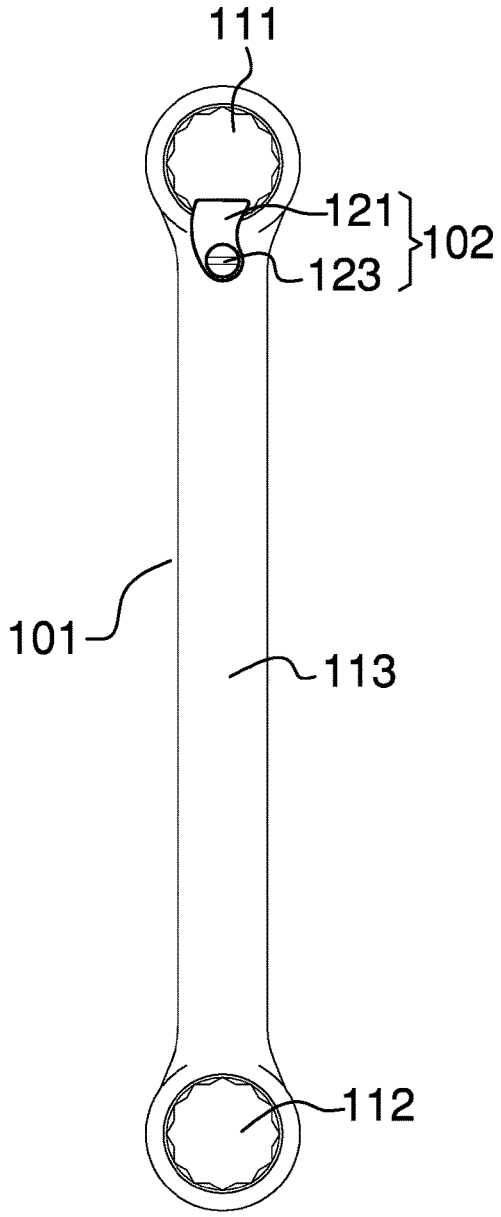
FIG. 3 is a top locked view of an embodiment of the disclosure.

Detailed reference will now be made to one or more potential embodiments of the disclosure, which are illustrated in FIGS. 1 through 3.

The wrench with position-retaining tab 100 (hereinafter invention) comprises a box wrench 101 and a position-retaining structure 102. The box wrench 101 is a hand tool used for tightening and loosening (hereinafter tightening/loosening) a threaded connection formed by a bolt or bolt-like structure 131 (hereinafter bolt/bolt-like structure). The box wrench 101 and the threaded connection are defined elsewhere in this disclosure. The position-retaining structure 102 attaches to the box wrench 101. The position retaining structure is a spring loaded structure that inhibits the box wrench 101 from slipping off the bolt/bolt-like structure 131 during the tightening/loosening of the threaded connection.

The box wrench 101 is a hand tool. The box wrench 101 is defined elsewhere in this disclosure. The box wrench 101 is configured for use in screwing a bolt/bolt-like structure 131 in order to tighten/loosen a threaded connection. The bolt and the threaded connection are defined elsewhere in this disclosure. The position-retaining structure 102 attaches to the box wrench 101. The box wrench 101 comprises a first working element 111, a second working element 112, and a lever 113.

The first working element 111 is a disk-shaped structure. The first working element 111 has a ring structure. The lateral face of the disk structure of the first working element 111 attaches to the lateral face of the disk structure of the lever 113 to form a lateral disk structure. The lateral face of the disk structure of the first working element 111 attaches to the lateral face of the disk structure of the lever 113 with the least span of distance. The inner diameter of the ring structure of the first working element 111 is sized such that the bolt/bolt-like structure 131 inserts into the interior negative space of the ring structure of the first working element 111.

The first working element 111 receives the bolt/bolt-like structure 131 such that the center axis of the prism structure of the bolt/bolt-like structure 131 aligns with the center axis of the disk structure of the first working element 111. The first working element 111 grips the bolt/bolt-like structure 131 such that the rotation of the lever 113 around the center axis of the disk structure of the first working element 111 will tighten/loosen the threaded connection formed by the bolt/bolt-like structure 131.

The second working element 112 is a disk-shaped structure. The second working element 112 has a ring structure. The lateral face of the disk structure of the second working element 112 attaches to the lateral face of the disk structure of the lever 113 to form a lateral disk structure. The lateral face of the disk structure of the second working element 112 attaches to the lateral face of the disk structure of the lever 113 that is distal from the first working element 111. The inner diameter of the ring structure of the second working element 112 is sized such that the bolt/bolt-like structure 131 inserts into the interior negative space of the ring structure of the second working element 112.

The second working element 112 receives the bolt/bolt-like structure 131 such that the center axis of the prism structure of the bolt/bolt-like structure 131 aligns with the center axis of the disk structure of the second working element 112. The second working element 112 grips the bolt/bolt-like structure 131 such that the rotation of the lever 113 around the center axis of the disk structure of the second working element 112 will tighten/loosen the threaded connection formed by the bolt/bolt-like structure 131.

The lever 113 forms a grip used to rotate a working element selected from the group consisting of the first working element 111 and the second working element 112 around the center axis of the disk structure of the selected working element. The lever 113 has a disk shape. The lateral face of the disk structure of the lever 113 attaches to the lateral face of the disk structure of the first working element 111 to form a lateral disk structure. The lateral face of the disk structure of the lever 113 attaches to the lateral face of the disk structure of the second working element 112 to form a lateral disk structure.

The position-retaining structure 102 is a retaining tab. The position-retaining structure 102 attaches to the box wrench 101 is such that the position-retaining structure 102 rotates relative to the box wrench 101. Specifically, the position-retaining structure 102 attaches to the lever 113 of the box wrench 101 is such that the position-retaining structure 102 rotate relative to the lever 113. The position-retaining structure 102 is an elastic structure. The position-retaining structure 102 rotates onto the bolt/bolt-like structure 131. The position-retaining structure 102 changes from a relaxed shape into a deformed shape when the position-retaining structure 102 is rotated onto the bolt/bolt-like structure 131. The deformation of the position-retaining structure 102 by the bolt/bolt-like structure 131 generates a counter force that secures the box wrench 101 to the bolt/bolt-like structure 131 during the tightening/loosening of the threaded connection. The position-retaining structure 102 comprises a spring disk 121, a mounting pedestal 122, and a mounting pivot 123.

The spring disk 121 is a disk-shaped structure. The spring disk 121 has a non-Euclidean disk structure. The spring disk 121 is a rotating structure. The spring disk 121 is an elastic structure. The spring disk 121 rotates from a position where the spring disk 121 is not in contact with a bolt/bolt-like structure 131 inserted into a working element selected from the group consisting of the first working element 111 and the second working element 112 into a position where the spring disk 121 is in contact with the bolt/bolt-like structure 131 inserted into the selected working element. The spring disk 121 deforms as the spring disk 121 comes in contact with the bolt/bolt-like structure 131 inserted into the selected working element. The deformation of the spring disk 121 by the bolt/bolt-like structure 131 generates a counter force that presses the lever 113 and the selected working element against the bolt/bolt-like structure 131 such that the deformation of the spring disk 121 secures the box wrench 101 to the bolt/bolt-like structure 131.

The mounting pedestal 122 is a prism-shaped structure. The spring disk 121 attaches to the lever 113 such that the spring disk 121 rotates relative to the lever 113. The mounting pedestal 122 attaches to a congruent end of the disk structure of the lever 113 such that the center axis of the prism structure of the mounting pedestal 122 projects vertically away from the lever 113. The spring disk 121 attaches to the congruent end of the mounting pedestal 122 that is distal from the lever 113. The mounting pedestal 122 forms an extension structure that sets the reach between the spring disk 121 and the lever 113. The spring disk 121 attaches to the mounting pedestal 122 such that the spring disk 121 rotates relative to the mounting pedestal 122.

The mounting pivot 123 is a shaft like structure. The mounting pivot 123 physically attaches the spring disk 121 to the mounting pedestal 122 such that the mounting pivot 123 forms a center of rotation around which the spring disk 121 rotates relative to the mounting pedestal 122.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bolt: As used in this disclosure, a bolt is a cylindrical shaft that is formed with an exterior screw thread. A bolt is defined with an outer diameter.

Box Wrench: As used in this disclosure, a box wrench is a wrench that has a fixed ring shaped structure as the working element. The box wrench is configured for use with a bolt or bolt-like structure as the specified structure. The negative space characteristic of the fixed ring shape structure is geometrically similar to the bolt or bolt like structure such that the head of the bolt or bolt-like structure inserts into the fixed ring shape structure. The lever of the wrench structure provides the leverage necessary to rotate the bolt or bolt-like structure during the screwing process.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Extension Structure: As used in this disclosure, an extension structure is an inert physical structure that is used to extend or bridge the reach between any two objects.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hand Tool: As used in this disclosure, a hand tool refers to a tool that is small and light enough to allow a person to hold the tool during use.

Inelastic Nature: As used in this disclosure, an inelastic nature refers to a flexible structure that maintains its new shape after the flexible structure has been deformed.

Lateral Disk Structure: As used in this disclosure, a lateral plate structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Lever: As used in this disclosure, a lever is a simple machine that comprises a shaft that rotates around a fulcrum, axis of rotation, or pivot point.

Lock: As used in this disclosure, a lock is a fastening device that fixes the position of a first object relative to a second object such that the first object and the second object are subsequently releasable.

Locking Tab: As used in this disclosure, a locking tab is a two element fastener wherein the first element of the fastener, which is mounted on a first object is a cantilever spring and the second element of the fastener is a hole which is formed in a second object. The free end of the cantilever spring has a hook formed in it such that when the free end of the cantilever spring is inserted into the hole, the hook latches against the edge of the hole preventing inadvertent removal of the cantilever spring. The first element is removed from the second element by bending the cantilever spring such that the hook clears the edge of the hole and then pulling the first element away from the second element.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reach: As used in this disclosure, reach refers to a span of distance between any two objects.

Relaxed Shape: As used in this disclosure, a structure is considered to be in its relaxed state when no shear, strain, or torsional forces are being applied to the structure.

Ring: As used in this disclosure, a ring is term that is used to describe a disk-like structure through which an aperture is formed. Rings are often considered loops.

Screw: As used in this disclosure, to screw is a verb meaning: 1) to fasten or unfasten (unscrew) a threaded connection; or 2) to attach a helical structure to a solid structure.

Socket: As used in this disclosure, a socket is an opening or a cavity that acts as a receptacle for an inserted part.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Tab: As used in this disclosure, a tab is a first object that is attached to a second object for the purpose of: facilitating the manipulation of the second object; or, 2) identification of the second object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tool: As used in this disclosure, a tool is a device, an apparatus, or an instrument that is used to carry out an activity, operation, or procedure.

Torsion Spring: As used in this disclosure, a torsion spring is a mechanical device that stores mechanical energy through an opposing torque when the mechanical device is bent or twisted. The torsion spring will return to its original relaxed shape when the twisting force is removed.

Working Element: As used in this disclosure, the working element of a tool is the physical element on the tool that performs the actual activity, operation, or procedure the tool is designed to perform. For example, the cutting edge of a blade is the working element of a knife.

Wrench: As used in this disclosure, a wrench is a tool that used to rotate a specified structure around an axis of rotation that is aligned with the center axis of the specified structure. The specified structure is selected from the group consisting of a prism and a composite prism. The wrench comprises a working element and a lever. The working element attaches to the selected structure such that the lever can rotate the selected structure. The working element of the wrench is often called the head. The portion of the working head that contacts the selected structure is called the profile. The lever is often called the handle.

With respect to the above description, it is to be realized that the optimum dimensional relationship for the various components of the invention described above and in FIGS. 1 through 3 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A wrench with position-retaining tab comprising a box wrench and a position-retaining structure;

wherein the position-retaining structure attaches to the box wrench;

wherein the box wrench tightens/loosens a bolt/bolt-like structure;

wherein the position retaining structure inhibits the box wrench from slipping off the bolt/bolt-like structure during the tightening/loosening of the threaded connection;

wherein the box wrench is a hand tool;

wherein the position-retaining structure attaches to the box wrench such that the position-retaining structure rotates relative to the box wrench;

wherein the position retaining structure is a spring loaded structure that inhibits the box wrench from slipping off the bolt/bolt-like structure during the tightening/loosening of the threaded connection.

2. The wrench with position-retaining tab according to claim 1 wherein the position-retaining structure is an elastic structure;

wherein the position-retaining structure rotates onto the bolt/bolt-like structure;

wherein the position-retaining structure changes from a relaxed shape into a deformed shape when the position-retaining structure is rotated onto the bolt/bolt-like structure;

wherein the deformation of the position-retaining structure by the bolt/bolt-like structure generates a counter force that secures the box wrench to the bolt/bolt-like structure during the tightening/loosening of the threaded connection.

3. The wrench with position-retaining tab according to claim 2 wherein the box wrench comprises a first working element, a second working element, and a lever;

wherein the lateral face of the disk structure of the first working element attaches to the lateral face of the disk structure of the lever with the least span of distance;

wherein the lateral face of the disk structure of the second working element attaches to the lateral face of the disk structure of the lever to form a lateral disk structure.

4. The wrench with position-retaining tab according to claim 3 wherein the position-retaining structure comprises a spring disk, a mounting pedestal, and a mounting pivot;

wherein the mounting pivot physically attaches the spring disk to the mounting pedestal.

5. The wrench with position-retaining tab according to claim 4 wherein the first working element is a disk-shaped structure;

wherein the first working element has a ring structure;

wherein the inner diameter of the ring structure of the first working element is sized such that the bolt/bolt-like structure inserts into the interior negative space of the ring structure of the first working element.

6. The wrench with position-retaining tab according to claim 5 wherein the second working element is a disk-shaped structure;

wherein the second working element has a ring structure;

wherein the inner diameter of the ring structure of the second working element is sized such that the bolt/bolt-like structure inserts into the interior negative space of the ring structure of the second working element.

7. The wrench with position-retaining tab according to claim 6 wherein the first working element receives the bolt/bolt-like structure such that the center axis of the prism structure of the bolt/bolt-like structure aligns with the center axis of the disk structure of the first working element;

wherein the second working element receives the bolt/bolt-like structure such that the center axis of the prism structure of the bolt/bolt-like structure aligns with the center axis of the disk structure of the second working element.

8. The wrench with position-retaining tab according to claim 7 wherein the first working element grips the bolt/bolt-like structure such that the rotation of the lever around the center axis of the disk structure of the first working element will tighten/loosen the threaded connection formed by the bolt/bolt-like structure;

wherein the second working element grips the bolt/bolt-like structure such that the rotation of the lever around the center axis of the disk structure of the second working element will tighten/loosen the threaded connection formed by the bolt/bolt-like structure.

9. The wrench with position-retaining tab according to claim 8 wherein the lever forms a grip used to rotate a working element selected from the group consisting of the first working element and the second working element around the center axis of the disk structure of the selected working element.

10. The wrench with position-retaining tab according to claim 9 wherein the lever has a disk shape.

11. The wrench with position-retaining tab according to claim 10 wherein the lateral face of the disk structure of the first working element attaches to the lateral face of the disk structure of the lever to form a lateral disk structure;

wherein the lateral face of the disk structure of the second working element attaches to the lateral face of the disk structure of the lever that is distal from the first working element.

12. The wrench with position-retaining tab according to claim 11 wherein the position-retaining structure attaches to the lever of the box wrench such that the position-retaining structure rotate relative to the lever.

13. The wrench with position-retaining tab according to claim 12 wherein the spring disk is a disk-shaped structure;

wherein the spring disk has a non-Euclidean disk structure;

wherein the spring disk is an elastic structure.

14. The wrench with position-retaining tab according to claim 13 wherein the spring disk is a rotating structure.

15. The wrench with position-retaining tab according to claim 14 wherein the spring disk rotates from a position where the spring disk is not in contact with a bolt/bolt-like structure inserted into a working element selected from the group consisting of the first working element and the second working element into a position where the spring disk is in contact with the bolt/bolt-like structure inserted into the selected working element;

wherein the spring disk deforms as the spring disk comes in contact with a bolt/bolt-like structure inserted into the selected working element;

wherein the deformation of the spring disk by the bolt/bolt-like structure generates a counter force that presses the lever and the selected working element against the bolt/bolt-like structure such that the deformation of the spring disk secures the box wrench to the bolt/bolt-like structure.

16. The wrench with position-retaining tab according to claim 15 wherein the mounting pedestal is a prism-shaped structure;

wherein the spring disk attaches to the lever such that the spring disk rotates relative to the lever;

wherein the spring disk attaches to the congruent end of the mounting pedestal that is distal from the lever.

17. The wrench with position-retaining tab according to claim 16 wherein the mounting pedestal attaches to a congruent end of the disk structure of the lever such that the center axis of the prism structure of the mounting pedestal projects vertically away from the lever;

wherein the mounting pedestal forms an extension structure that sets the reach between the spring disk and the lever;

wherein the spring disk attaches to the mounting pedestal such that the spring disk rotates relative to the mounting pedestal.

18. The wrench with position-retaining tab according to claim 17 wherein the mounting pivot is a shaft like structure;

wherein the mounting pivot physically attaches the spring disk to the mounting pedestal such that the mounting pivot forms a center of rotation around which the spring disk rotates relative to the mounting pedestal.

* * * * *